US007708248B2

(12) United States Patent
Lagobi

(10) Patent No.: US 7,708,248 B2
(45) Date of Patent: May 4, 2010

(54) CONTAINER HOLDER

(76) Inventor: Karim Lagobi, 265 W. Tujunga Ave., #209, Burbank, CA (US) 91502

( * ) Notice: Subject to any disclaimer, the term of this patent is extended or adjusted under 35 U.S.C. 154(b) by 0 days.

(21) Appl. No.: 11/938,424

(22) Filed: Nov. 12, 2007

(65) Prior Publication Data

US 2009/0121107 A1 May 14, 2009

(51) Int. Cl.
*A47K 1/08* (2006.01)

(52) U.S. Cl. ..... 248/313; 248/311.2; 248/231.21

(58) Field of Classification Search ..... 248/229.13, 248/229.16, 229.23, 229.26, 311.2, 230.1, 248/226.11, 228.7, 228.4, 230.4, 231.51, 248/231.81

See application file for complete search history.

(56) References Cited

U.S. PATENT DOCUMENTS

| | | | | |
|---|---|---|---|---|
| 2,515,523 | A * | 7/1950 | Mancino | 248/312.1 |
| 7,044,139 | B2 * | 5/2006 | Tong | 132/225 |
| 7,284,737 | B2 * | 10/2007 | Kane | 248/311.2 |
| 2001/0032915 | A1 * | 10/2001 | Clifford | 248/311.2 |

* cited by examiner

*Primary Examiner*—J. Allen Shriver, II
*Assistant Examiner*—Alaeddin Mohseni

(57) ABSTRACT

The invention provides a device having a clamp-like structure with jaws designed to bite onto a support, and at least one of the handles shaped like a ring in order to serve as a receptacle for holding a cup-like container. A user may easily attach the device to a solid support in order to hold a liquid container. The holder may be used in work areas such as desks, tables and the like in order to prevent beverage spillage. The invention provides multiple designs that enable a device to adapt to supports with various thicknesses.

4 Claims, 5 Drawing Sheets

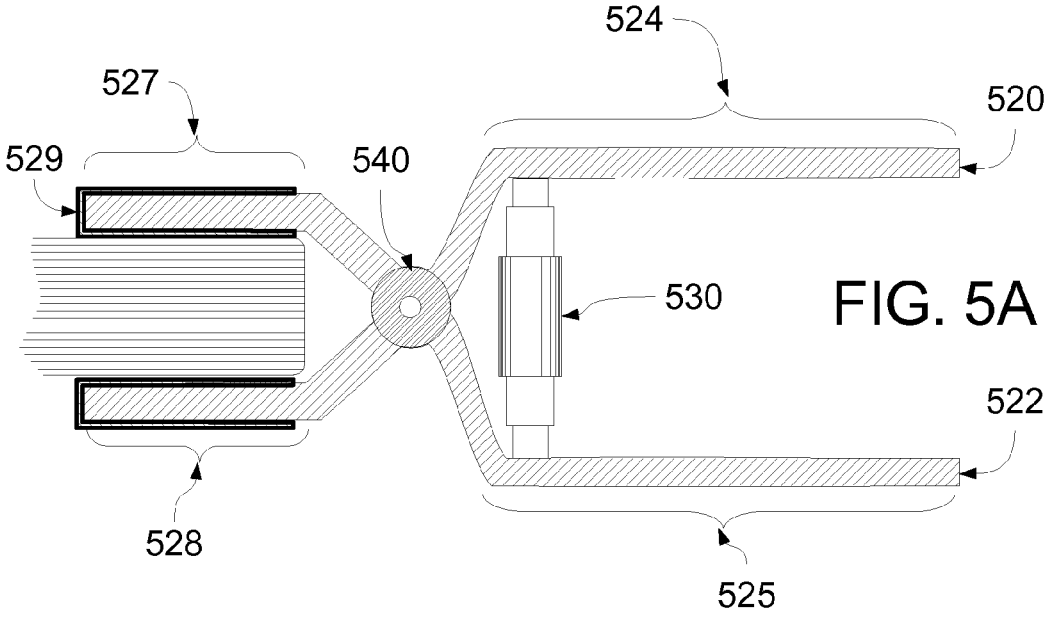
FIG. 5A
FIG. 5B
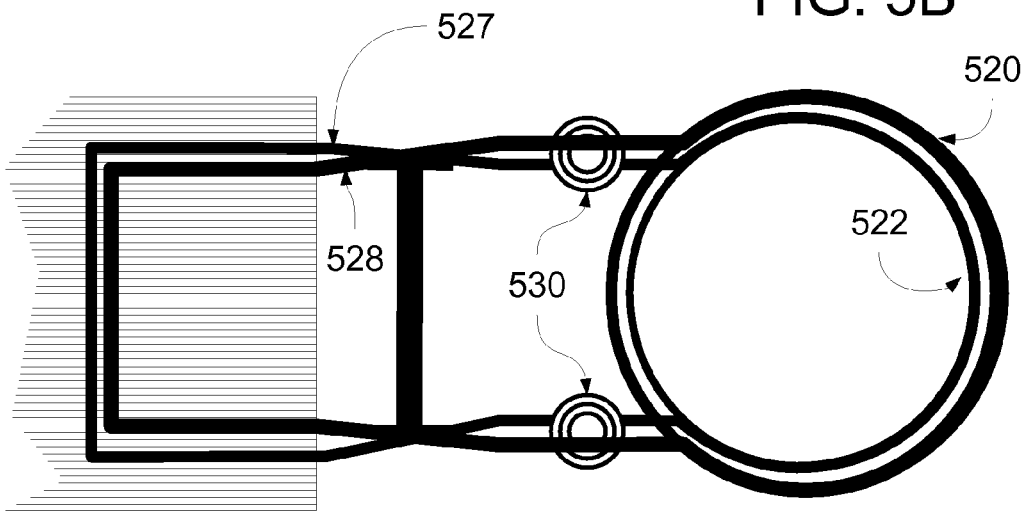

CONTAINER HOLDER

FIELD OF THE INVENTION

The invention relates to a removeably attachable device for holding a liquid container such as a cup or mug to a solid support such as a desk, a table or a workbench.

A portion of the disclosure of this patent document contains material which is subject to copyright protection. The copyright owner has no objection to the facsimile reproduction by anyone of the patent document or the patent disclosure, as it appears in the Patent and Trademark Office file or records, but otherwise reserves all copyrights associated with this document.

BACKGROUND OF THE INVENTION

Consuming a beverage is always accompanied with a risk of accidental spillage, especially while the person consuming the beverage is also conducting other tasks such as working or driving. But, while there seems to be numerous beverage holders adapted for the high risk situations, such as in moving vehicles, there is a lack of versatile beverage holders adapted for fixed supports such as desks or workbenches. A spillage may be very costly no matter how infrequently it may happen, especially that working at a desk generally involves paper documents, electronic devices such as a computers or mixing tables or computer peripherals such as computer keyboards that may be easily damaged by water.

There exists numerous cup holders designed for work areas. But, these are either incorporated in the furniture, or may require that at least a portion of the cup holding device be permanently mounted (or affixed) to a solid support such as a wall, a rail or a piece of furniture. For example, Thomason (U.S. Pat. No. 5,102,086) describes a cup holder that may be removeably attached to a supporting structure, but it does seem inadequate for day-to-day use because it requires that a portion of the holder be mounted to a support structure and serve as an attachment point for the rest of the assembly.

What is needed is a versatile cup holder designed to be securely attachable to any piece of furniture while being easy to remove and relocate. The invention provides a versatile cup holder easily attachable to a support structure, without requiring any assembly for attaching to the support and without requiring disassembly for removal and relocation.

SUMMARY OF THE INVENTION

The invention addresses a particular need: try to avoid spillage (of a beverage for example) at a desk, table or workbench, which would likely cause damage to paper documents, electronic equipments, furniture or any other work equipment that may be damaged by water or any other spilled liquid. The invention provides a versatile holder that is easy to attach to the edge of a support such as table or a desk, and that does not require any complicated mounting to attach or dismounting to remove.

The liquid container holder comprises a pair of gripping elements and at least one biasing means assembled in a plier clamp fashion. Each of the gripping elements has a jaw section designed to be place around a support structure, and a handle section. The handle section of at least one of the gripping elements is hollowed in ring-like shape and adequately sized in order to serve as a horizontal receptacle for a cup, a glass or the likes. A user may install the cup holder onto the edge of a table, for example, simply by pressing the handles toward one another, which opens the jaws, then placing the jaws around the edge, then releasing them, which causes the jaws to bite onto the support. The ring-like shape of the handle (or both handles in other instances) should have its plane positioned horizontally, thus providing a receptacle through which a cup may be inserted and held stably.

Given that tables and desks and the likes possess various thicknesses to which a cup holder may be attached according to the invention, it would be apparent to one it ordinary skills in the pertinent art that a simple design would work best only with a small range of thicknesses of the support. To address the latter issue, the invention provides several ways in which a device may be built in order to accommodate for several thicknesses. For example, the device may possess an adjustment mechanism that allows a user to make adjustments such that when the device is placed onto a support, the handles are optimally positioned to hold a cup.

The invention provides, in particular, a design that allows a device embodying the invention to self-adjust to various thicknesses of the support at the jaws level, while providing optimally positioned handles for holding a cup. In the latter device, at least one of the gripping elements comprises dissociated jaw and handle sections. The jaw section is able to bite onto a support within a wide range of thicknesses, while the handle section is designed to exert a force on the jaw section when pivoted in one direction, and returns to resting position when relaxed. The latter design allows device embodying the invention to adapts to various thicknesses of the holder without requiring any adjustment from the user.

The invention fulfills a need for a cup holder that is versatile because of its ease of use and because it provides improved protection when having a liquids around paper-based work material and electronic devices. The improved protection is particularly salient in the event of an accidental spillage of a liquid, since a device embodying the invention is preferably designed to attach to the edge of a work area, causing the liquid to fall below the work area (e.g., on the floor) instead of on the work area.

DESCRIPTION OF THE DRAWINGS

FIG. 5A depicts a lateral view of a device having crossed gripping elements and telescopic springs in accordance with one embodiment of the invention.

FIG. 5B depicts a top view of a device having crossed gripping element and telescopic springs in accordance with one embodiment of the invention.

FIG. 8Aa depicts a lateral view of a self adjusting cup holder while it is attached onto a support structure in accordance with one embodiment of the invention.

DETAILED DESCRIPTION OF THE INVENTION

Figure 1A:
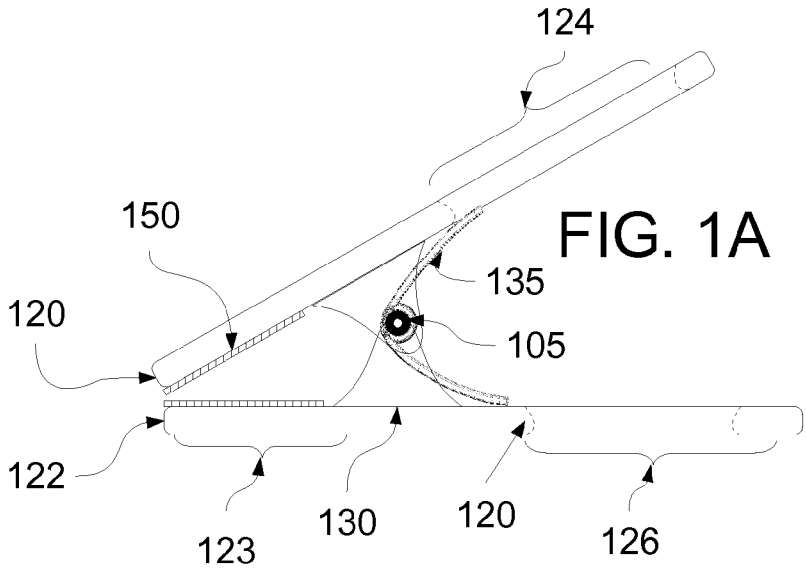
FIG. 1A depicts a lateral view of a cup holder in accordance with one embodiment of the invention.

An embodiment of the invention is a device removeably attachable to a solid support to provide a receptacle for holding a liquid container such as a glass, a cup, a bottle or any other container.

In the following description, numerous specific details are set forth to provide a more thorough description of the invention. It will be apparent, however, to one skilled in the pertinent art, that the invention may be practiced without these specific details. In other instances, well known features have not been described in detail so as not to obscure the invention. The claims following this description are what define the metes and bounds of the invention.

Throughout the following description, the terms cup and container may interchangeably refer to any liquid container, such as a cup, a bottle, a bowl, or any utensil used for holding a liquid product such as a beverage, paint, ink or any other fluid substance.

In the description, references to solid support and furniture are also interchangeably used to refer to any support structure capable of holding the device described in the following disclosure. For example, a support comprises a desk, a table, a workbench, a bench, a shelf, a bookshelf, a ladder, rail such as a bed side rail or a stair rail, an armchair or any other structure capable of holding the cup holder disclosed herein.

Basic Implementation

The invention may be embodied as a clamping device having a pair of gripping elements each of which having a jaw section and a handle section; at least one of the gripping elements having a generally ring-shaped handle the plane of which provides a receptacle for receiving a liquid container. The gripping elements may be joined by a bridging section that comprises at least one axis about which the gripping element may move bringing the jaw sections together or splaying them apart. The device also comprises at least one biasing means to urge the jaws toward one another.

The user may place the jaws around a solid support (e.g., a table or a desk) and lock them in place to the support. The user may place the device such that the plane of ring-shaped handles is placed horizontally, thus providing a holding receptacle for placing a generally cup-shaped liquid container by inserting the container through one or both ring-shaped handles.

One or more parts of the device may utilize plastic-based materials, metal, wood or any combination thereof. In addition, one or more biasing means, such as a coil spring, a telescoping spring, a torsion bar and/or any part made of elastic material, provided that it allows a user to exert a force on the handles of the gripping elements to cause the jaws to open and/or close.

It would be apparent to one with ordinary skills in the art of mechanical engineering that several factors would guide one in designing and building a device according to the invention. The geometry and dimensions of such a device depend on the ergonomics that make the device easy to hold and manipulate by a user's hand, the size of the target container to be held, and the aesthetics of the device. The latter factors in addition to the weight of the target container should dictate the constraints to be respected while choosing the construction material, the spring force, type, number and location(s). For example, the dimensions of the device are to depend on the size and weight of the target liquid containers to be held, wherein one or more materials from which the device is to be made should provide enough strength to hold the container and enough grip to hold onto a solid support, while the geometry and the characteristics of the biasing means are to allow a user to comfortably manipulate the device while providing enough force to keep the device stably attached to the support.

Figure 1B:
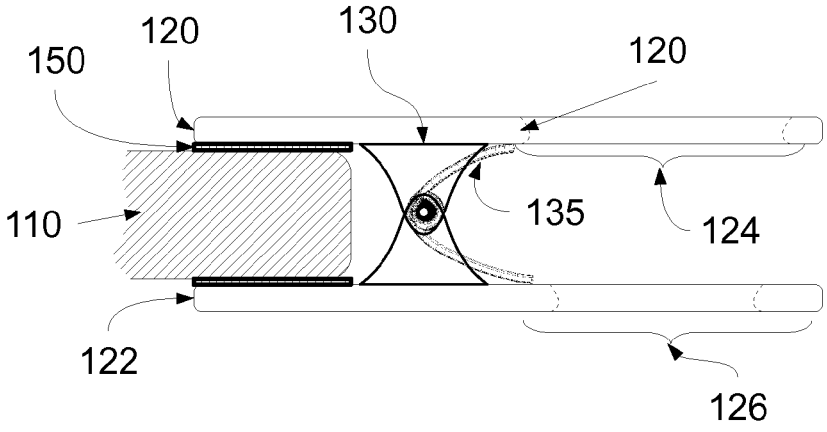
FIG. 1B depicts a lateral view of a cup holder while the device is attached onto a solid support in accordance with one embodiment of the invention.

FIGS. 1A and 1B depict a lateral view of a cup holder in accordance with one embodiment of the invention. FIG. 1A shows a device embodying the invention in a resting position i.e. the device is not attached to any solid support. FIG. 1B shows the device having been attached to a solid support 110 such as the edge of a desk or a table. In the latter basic implementation, the device, as represented in FIGS. 1A and 1B, comprises a pair of gripping elements 120 and 122. Each of the gripping elements comprises a jaw section (e.g., section 123), and a handle section (e.g., sections 124 and 126).

In the depictions of FIGS. 1A and 1B, the handle section of at least one of the gripping elements is shaped so that it may provide a receptacle for receiving a beverage container such as a cup or a glass. For example, for one or both gripping elements, the handle may be wide and flat with a generally circular bore having a diameter adequate for receiving a standard cup, glass, mug or any other liquid container. The ring-like shape may not be fully closed, such as a pair of outward bifurcating rods that are curved in a ring-like shape forming a rim inside which a cup can be inserted and held.

The device, depicted in FIGS. 1A and 1B, comprises a bridging element 130 that provides a link basis for connecting the gripping elements 120 and 122. The bridging element 130 may not necessarily be an independent part since it may be cast as a portion of the gripping elements. For example, the gripping elements may be cast such that they possess protrusions that may be mounted against each other around an axis (e.g., axis 105).

The bridging element 130 may comprise one or more biasing means 135. A biasing element may comprise a coil spring, a telescoping spring, a torsion bar or any adequate part, such as an elastic material. The biasing element may be mounted such that the recall force of the biasing means may be constantly urging the jaws toward one another.

In order to enhance the gripping action of the jaw sections, at least one of the jaws may comprise a padding piece 150. The padding may comprise one or more layers of one or more materials possessing grip-enhancing properties. Such materials comprise rubber, silicon-based material, plastic padding or any other material suitable for improving grip between the jaw and a surface of a support structure. Also, depending on the material used for padding, the contact surface may be smoothed or roughed in order to increase the gripping force. For example, a rubber padding may be glued to the inner side of at least one of the jaws in order to increase grip between the jaw and the solid support body 110.

FIG. 1B shows a device embodying the invention in a position where the jaws have been locked to a solid support 110. FIG. 1B shows the device as locked to a horizontal support surface, thus making at least one of the handles provide a horizontal receptacle through which a user is able to insert a cup to be stably held.

Figure 2:
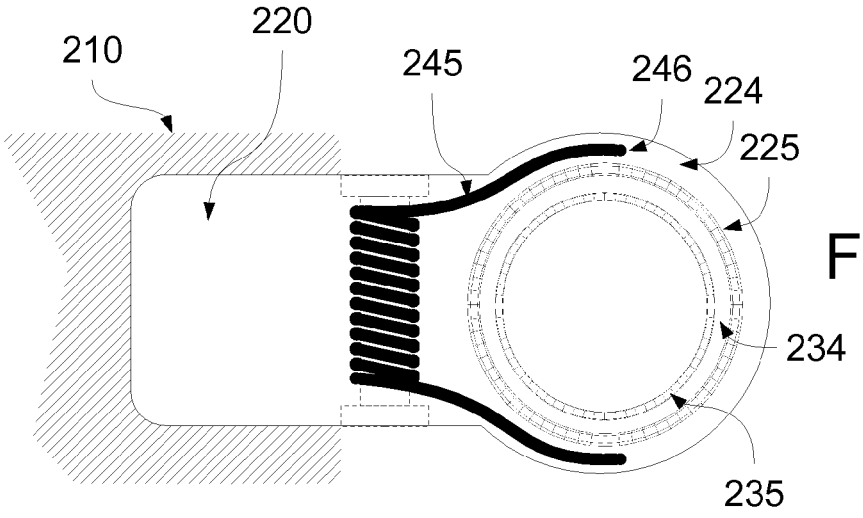
FIG. 2 shows a top view of a device embodying the invention.

FIG. 2 shows a top view of a device embodying the invention. In the latter depiction, the jaw section 220 holds onto a flat support 210. The device comprises a top handle section 224 and a bottom handle section 234 that (in the latter instance) both have a generally circular shape. Since a generally circular section of liquid containers is the most common shape, the ring-like handle is preferable to embody the invention. However, a device embodying the invention may be designed with any shape type depending on the target application. Furthermore, the inner rim of the top handle 225 may be wider than the inner rim of the bottom handle 235 in order to accommodate for a tapered shape that is the most common shape of drinking cups and glasses.

The device depicted in FIG. 2 also depicts a coil spring 245 that serves to urge the jaws toward one another. The coil spring may have arm-like ends extending away from spring. One spring end (e.g., extension 246) may push against one handle while the second arm of the spring may push against the second handle. Thus, by applying a splaying force on the handles, the spring exerts a closing force on the jaws.

Figure 3:
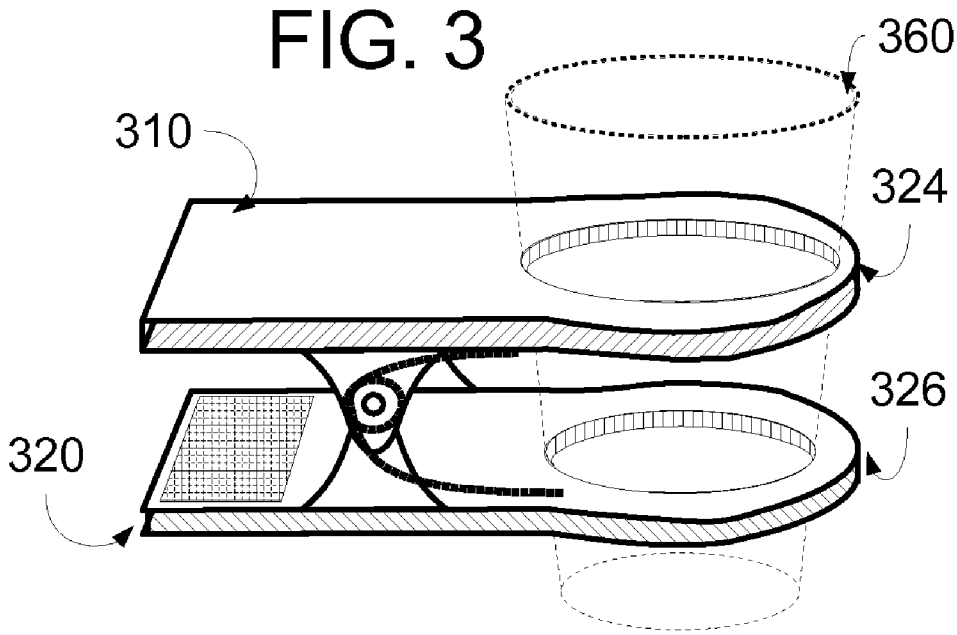
FIG. 3 shows a perspective view of a device designed to hold a standard cup-shaped container in accordance with an embodiment of the invention.

FIG. 3 shows a perspective view of a cup holder in accordance with one embodiment of the invention. The device depicted in FIG. 3 shows that both handles 324 and 326 provide a generally circular receptacle able to hold a cup 360 or a portion thereof. For example, the handles of the device may have intentionally selected diameters such that when the top portion of a cup rests against the inner rim of the top handle 324, a lower portion of the cup may rest against the inner rim of the bottom handle 326. Additionally, the device may be designed such that one handle may accommodate one standard cup size, and the second handle a different standard cup size (e.g., medium vs. large cup sizes). For example, the device depicted in FIG. 3 may be able to hold a large cup when handle 324 is positioned at the top and handle 326 is positioned at the bottom (e.g., as shown in FIG. 3); whereas the device may adequately hold a smaller cup when the device is attached so the handle with the smaller diameter (e.g., handle 326) is positioned at the top.

Variations and Enhancements of the Basic Implementations

A basic implementation of the invention as described above, although sufficient to provide an easy-to-use container holder, may be enhanced to further improve its functionality. The enhancements comprise a number of design features (or combination thereof) that enable the holder to adjust to more than one cup size, adjust to more than one thickness size of the solid support, and provide enhanced stability of the cup in place. For example, the gripping elements may be cast in one piece, or may be assembled from several parts (e.g., a jaw section, a middle section and the handle section). In one or more instances, a soft piece of material may be utilized inside the rim of the handle as a cushion against which a cup rests.

Figure 4:
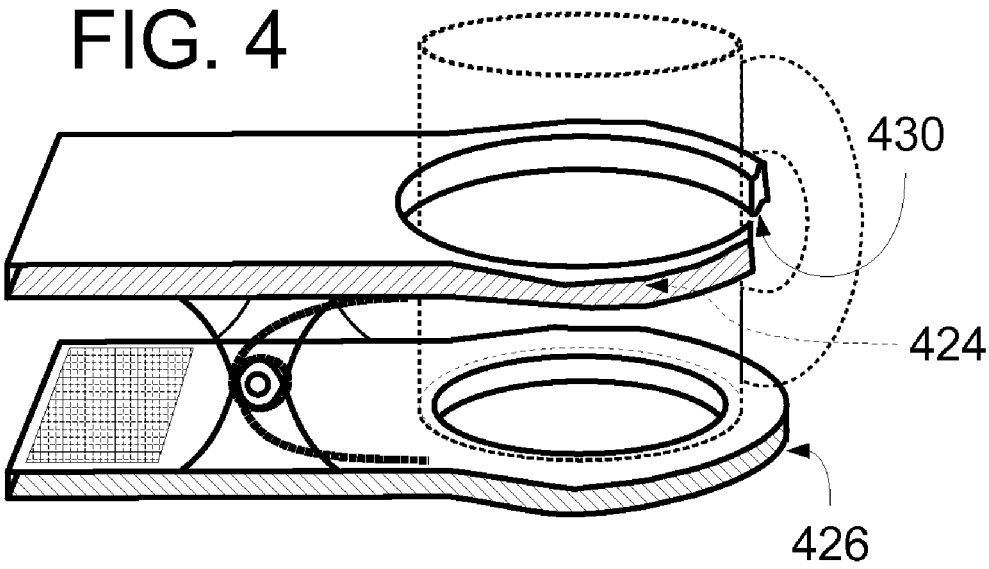
FIG. 4 shows a perspective view of a device designed to hold a standard mug-shaped container in accordance with an embodiment of the invention.

In addition to having a variety of handle shape and size to accommodate one or more liquid containers, a device embodying the invention may be designed to accommodate for other features of containers. For example, FIG. 4 shows a perspective view of a device embodying the invention designed to accommodate for the shape of a mug. The device of FIG. 4 provides a gap 430 in the top handle 424 to accommodate for the mug handle. In the latter example, the diameter of the lower handle 426 may be made too narrow for a mug to pass through, thus providing a resting platform for a mug, while allowing a smaller diameter cup (e.g., a tapered cup) to partially pass through the bottom handle and rest against its inner rim.

FIGS. 5A and 5B illustrate a variation on the geometry of a cup holder in accordance with an embodiment of the invention. FIGS. 5A and 5B depict a side view and a top view, respectively, of a device having gripping elements 520 and 522 mounted in a scissors-like manner. The handle sections 524 and 525 are on opposite sides of their respective jaw sections 528 and 527 of the gripping elements. At least one of the gripping elements has a handle ring-like shaped to form a receptacle for holding a cup. In the example depicted in FIGS. 5A and 5B, the device utilizes two telescopic springs as a biasing means. In addition, the jaws may be coated by a rubbery substance (e.g., coating 529) in order to enhance the grip of the jaws onto a support. FIGS. 5A and 5B intend to show that the invention may be embodied using a variety of design features without departing from the spirit of the invention.

In the basic implementation, the gripping elements are parallel at a given distance between the jaws i.e. when the device is attached to a horizontal platform both handles should provide a horizontal plane to serve as a holder. However, the top platform of desks, tables and work benches may measure from a fraction of an inch to several inches in thickness. Consequently, with thicknesses that significantly vary from the optimal thickness of the solid support, the latter device would present an angle between the gripping elements, which may be inconvenient in some cases.

The invention provides further design features that allow an embodiment of the invention to grip to solid supports having various thicknesses. The design features may, for example, allow a user to adjust the gap size between the jaws in order to adapt the cup holder to a particular support.

Figure 6:
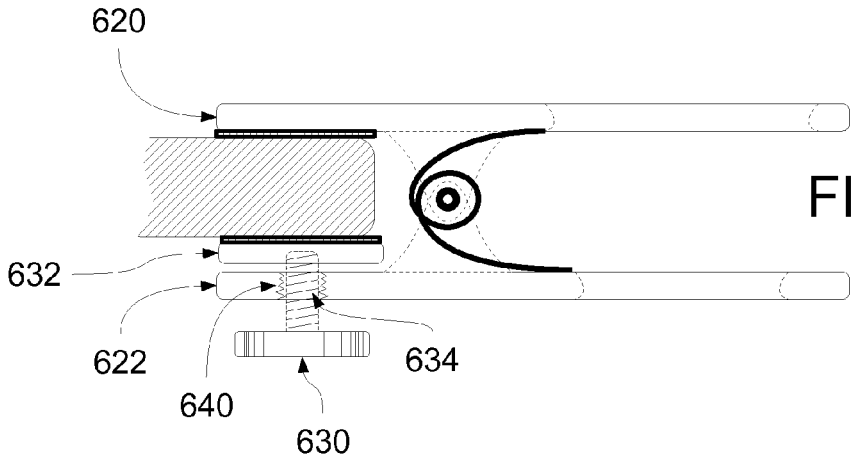
FIG. 6 depicts a cup holder having a mechanism for adjusting the gap between the jaws in an embodiment of the invention.

FIG. 6 depicts a cup holding device having an adjustable gap between the jaws in an embodiment of the invention. In FIG. 6, the gripping elements 620 and 622 are similar to the ones previously described (e.g., in FIG. 1A or 1B), with an additional mechanism that allows the gap between the jaws to be adapted to various thicknesses of the support. In the latter instance, at least one of the jaw sections has a threaded hole 640 through which a screw 634 may be inserted such that turning the head of the screw 630 may result in narrowing the space between the jaws. An additional part 632, such as a wide piece of metal or plastic, may be loosely attached to the end of the screw in order to allow the screw to turn without causing friction with the support while allowing a big enough contact patch with the support. A user may adjust the distance between the jaw sections in order to bring the handles to a desirable position when the device is placed onto a support.

Figure 7:
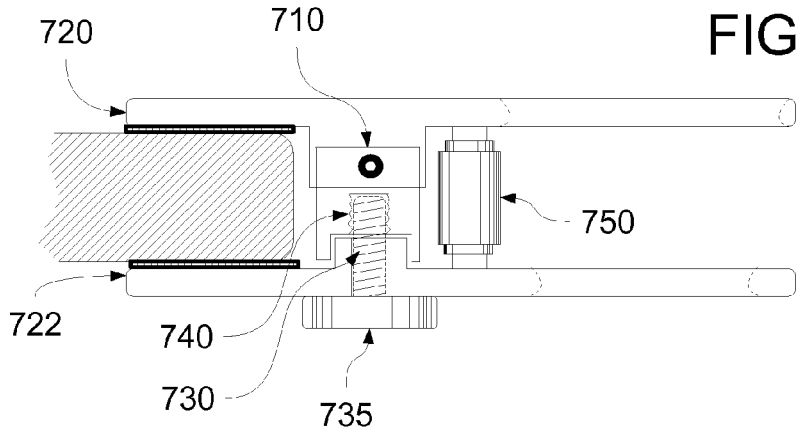
FIG. 7 depicts a cup holder having a mechanism for adjusting the distance between the gripping elements at the bridging element level in accordance with one embodiment of the invention.

FIG. 7 depicts a cup holding device having an adaptable distance between the gripping elements in an embodiment of the invention. FIG. 7 is another instance of how one or more design features may be implemented to build an enhanced device based on the basic idea of the invention. The bridging section 710 that connects the gripping elements 720 and 722 may be equipped with a mechanism that allows a user to adjust the distance between the gripping elements, thus, adapting a device to a desired thickness. The bridging element 710 may comprise two (2) movably connected parts. On the one side of the bridging element (e.g., side of gripping element 720) the bridging element may comprise a threaded hole 740 through which a screw 730 may be inserted. The screw 730 may be mounted such that it traverses the opposite gripping element (e.g., gripping element 722). A user may adjust the size of the bridging element by turning the screw head 735, which results in adjusting the distance between the gripping elements.

The example implementation of FIG. 7 further shows that a device may utilize a telescopic spring 750 mounted in such a way that the force exerted by the springs tend to splay the handles apart, thus urging the jaw toward one another.

The preferred embodiment of the invention is a self-adjusting device i.e. one that allows a user to easily attach and relocate the cup holder without requiring further adjustments from the user. The latter may be achieved, for instance, by constructing a device where at least one of the gripping elements is comprised of disjoint jaw and handle sections. Each of the two sections is movably connected to the device (e.g., to a bridging element). Such a design would allow the handle to rest in one position that is optimal for holding a container, while the jaw section may grip onto solid supports having various thicknesses. Since the sections are separated they may move freely about their respective axes. The invention contemplates using shape protrusions on the handle and/or the jaw sections such that the free movement of either section is limited to within a given range. A user may move the handle section within a given range without affecting the movement of the jaw section. When the handle comes in contact with the jaw section, the handle section then drives the jaw section to open up, thus, allowing the user to place the device onto a support. Once released, the handle may then go back to a resting position.

Figure 8A:
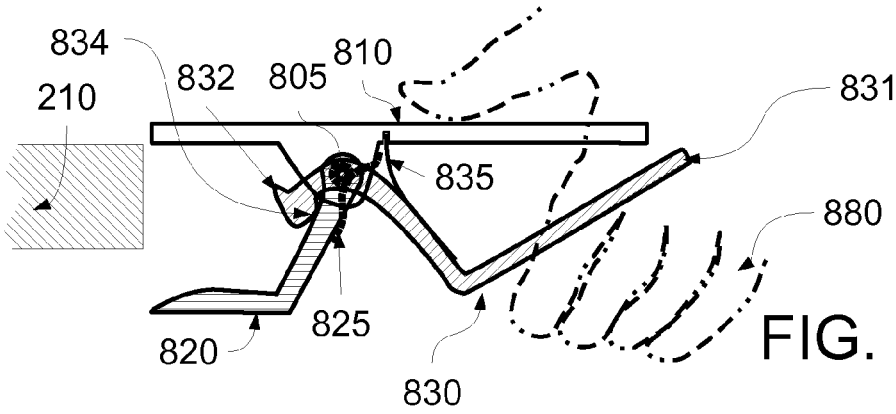
FIG. 8A depicts a lateral view of a self adjusting cup holder while it is being actioned by a user's hand to place the holder onto a support structure in accordance with one embodiment of the invention.
Figure 8A:
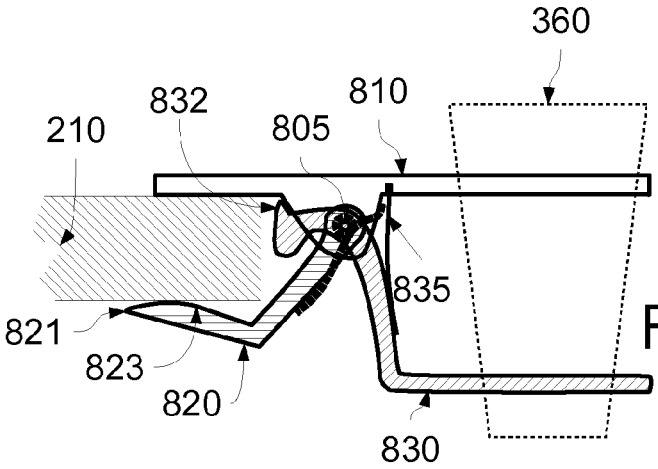
Figure 8B:
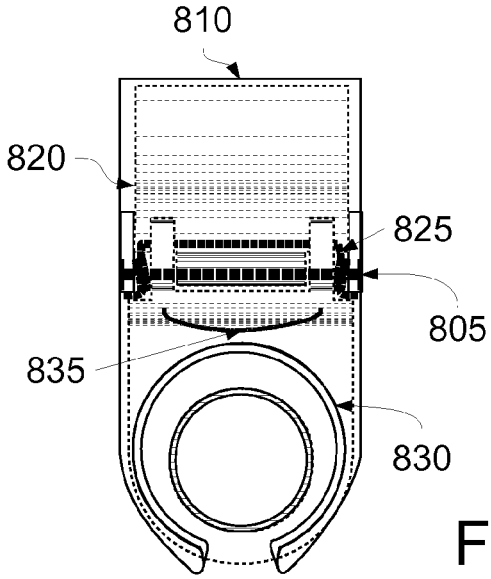
FIG. 8B depicts a top view of a self-adjusting cup holder in accordance with one embodiment of the invention.

FIGS. 8A and 8B depict a lateral view and a top view, respectively, of a self-adjusting cup holder in accordance with one embodiment of the invention. In FIGS. 8A and 8B, one handle (e.g., top handle 810) may be built in one piece similarly to one of the gripping elements described above. The device has a handle 830 and a jaw 820 sections that are attached (in this instance) to the device at one axis 805. A spring 825 may be utilized to urge the lower jaw 820 toward the jaw of the upper handle. A second spring 835, for seating the device, may be utilized to urge the handle 830 to rest at a given position (e.g., as shown in the depiction of handle 830). The positioning of the handle 830 may be aided by shape features such as a protrusion (e.g., protrusion 832) that allow the handle to rest against the gripping element 810 under the force of biasing means 835.

FIG. 8A and FIG. 8Aa schematically depicts two positions of the jaw section: the jaw section is able to lock onto a relatively thick support as shown in FIG. 8A as well as relatively less thick supports (e.g., as schematically illustrated by 821 in FIG. 8Aa). The surface of the jaw destined to contact the support may be shaped to maximize the size of the contact patch (e.g., patch 823) between the jaw and the support.

FIG. 8Aa depicts a lateral view of a self adjusting cup holder while it is attached onto a support structure in accordance with one embodiment of the invention. The device is attached to a support structure and the handle of the disjointed gripping element is in a resting position.

FIG. 8A and FIG. 8Aa show that the handle 830 may move about an axis (e.g., 805). A user's hand 880 may press the handles of both gripping elements toward one another causing the handle 830 (in position 831) to rotate about axis 805. The handle may be enhanced with shape features such as a protrusion (e.g., protrusion 834) such that within a given range of movement the protrusion may bring the handle 830 in contact with the jaw 820, thus, allowing the user to open the jaws in order to place the device onto a support. FIG. 8A schematically depicts the position of the handle (e.g., position 831) when the handles are squeezed together toward one another. After the user releases the handles the lower handle returns to a resting position (e.g., as shown in FIG. 8Aa).

Thus a versatile device for holding a liquid container allowing a user to easily attach the device to a solid support, and easily remove and/or relocate the device without requiring mounting of any of the parts of said device. Particular embodiments described herein are illustrative only and should not limit the present invention thereby. The invention is defined by the claims and their full scope of equivalents.

The claimed invention is:

1. A container holder removeably attachable to a support, without requiring permanent mounting of any of its parts to said support, said holder comprising:

a pair of gripping elements comprising a first gripping element and a second gripping element, wherein said first gripping element further having a first handle section and first jaw section, wherein said first handle section is solidly connected to said first jaw section, wherein said second gripping element further having a second jaw section and a second handle section, wherein said second jaw section and said second handle section are disjointly connected at about a first rotation axis, wherein said second jaw section and said second handle section rotate about said first rotation axis, and wherein said first handle section and said second handle section are shaped like a ring so that when said first gripping element and said second gripping element are mounted to a horizontal support the ring-shape allow said first handle section and second handle section to hold a cup;

a bridging element for connecting said first gripping element and said second gripping element, said bridging element providing at least one second rotation axis about which said pair of gripping elements are able to rotate relatively to one another so that said first jaw section and said second jaw section are caused to be pried open by applying a hand force urging said first handle section and said second handle section toward one another; and at least one first biasing means for constantly exerting a force that urges said first jaw section and said second jaw section toward one another resulting in a clamping action of the jaws when placed around a support.

2. The container holder of claim 1 wherein said second handle section further comprises a first shape feature (834) to bring said second handle section in contact with said second jaw section, and wherein said second handle section further comprises a second shape feature (832) to bring said second handle section in contact with said first gripping element.

3. The container holder of claim 2 wherein said first shape feature is further sized to allow said second handle section to moved with a range before contacting said second jaw, while under said hand force.

4. The container holder of claim 1 further comprising at least one second biasing means for exerting a restraining force to bring said second handle to a resting position, wherein said resting position puts the ring-shaped second handle section substantially parallel to said first handle section.

* * * * *